US006206995B1

(12) United States Patent
Lauderbaugh

(10) Patent No.: US 6,206,995 B1
(45) **Date of Patent: *Mar. 27, 2001**

(54) MOVING-WEB SLACK REDUCING SYSTEM INCLUDING A DEFORMABLE TENSION ROLLER

(75) Inventor: David Lauderbaugh, Roswell, GA (US)

(73) Assignee: Corrugated Gear & Services, Inc., Alpharetta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/886,790

(22) Filed: Jul. 1, 1997

(51) Int. Cl.[7] ..... B31F 1/20

(52) U.S. Cl. ..... 156/205; 156/470; 156/494; 156/495; 34/637; 34/454

(58) Field of Search ..... 226/195, 191; 242/419, 419.8; 34/624, 625, 637, 443, 452, 453, 454; 156/205, 210, 470, 494, 495; 492/30, 31

(56) References Cited

U.S. PATENT DOCUMENTS

| | | | | |
|---|---|---|---|---|
| 2,287,768 | | 6/1942 | Eckstein | 271/2.1 |
| 2,660,218 | | 11/1953 | Johnson et al. | 154/42 |
| 2,781,535 | | 2/1957 | Phillips et al. | 15/77 |
| 2,852,791 | | 9/1958 | Febinger | 15/77 |
| 3,018,975 | | 1/1962 | Kulicke, Jr. | 242/54 |
| 3,195,159 | | 7/1965 | Enchelmaier et al. | 15/77 |
| 3,209,429 | | 10/1965 | Amtmann | 29/81 |
| 3,285,484 | * | 11/1966 | Johnson | 226/85 |
| 3,630,806 | * | 12/1971 | Kitajima et al. | 156/472 |
| 3,854,646 | | 12/1974 | Dorfel et al. | 226/191 |
| 4,086,116 | * | 4/1978 | Yazaki et al. | 156/205 |
| 4,187,132 | * | 2/1980 | Dijk et al. | 156/88 |
| 4,782,988 | * | 11/1988 | Nishiyama | 226/52 |
| 4,964,583 | * | 10/1990 | Yukumoto et al. | 226/182 |
| 5,419,509 | * | 5/1995 | Krayenhagen | 242/419 |

FOREIGN PATENT DOCUMENTS

| | | |
|---|---|---|
| 131896 | 10/1946 | (AU) . |
| 311653 | 12/1917 | (DE) . |
| 2089436 | 1/1972 | (FR) . |
| 39-19088 | 12/1962 | (JP) . |

OTHER PUBLICATIONS

Drawings 1–11 of Australian Patent 152,658.

* cited by examiner

*Primary Examiner*—Michael W. Ball
*Assistant Examiner*—Barbara J. Musser
(74) *Attorney, Agent, or Firm*—Gardnder & Groff, P.C.

(57) ABSTRACT

A moving-web slack reducing system including a deformable tension roller, such as a brush-type tension roller having an outer surface defined by the ends of a plurality of bristles. The slack reducing system may be deployed in a preheater assembly for a machine for manufacturing corrugated board. The bristles of the deformable tension roller allow the outer surface of the tension roller to deflect both radially and in the cross-machine direction without binding to the paper web. The bristles may also deflect variably across the tension roller in the cross-machine direction. Thus, the deflection of the bristles adjusts automatically and virtually instantaneously to changes in the tension of the paper web to compensate for variations in tension across the web in the cross-machine direction. This allows the brush-type tension roller to take the slack out of the paper web without having to rapidly and precisely adjust any actuators.

13 Claims, 2 Drawing Sheets

MOVING-WEB SLACK REDUCING SYSTEM INCLUDING A DEFORMABLE TENSION ROLLER

TECHNICAL FIELD

This invention relates to moving-web assembly lines and, more particularly, to a moving-web slack reducing system including a deformable tension roller. Specifically, the slack reducing system may be applied in a preheater assembly for a machine for manufacturing corrugated board.

BACKGROUND OF THE INVENTION

Corrugated board can be manufactured in many different widths and thicknesses. The thickness of the board is determined by the number of medians and liners in the board. First, corrugations or flutes are created in a paper median by passing the median through a corrugator. Then, an alternating series of paper liners and paper medians, with an adhesive between each layer, are brought together in a moving web to form a board of desired thickness. The moving web passes through an assembly line that includes a hotplate section, where heat and pressure are applied to dry the adhesive, and a cooling section, where the board is cooled. The moving web is then cut and scored to make board of different shapes and sizes for boxes and other items.

Uneven moisture content in the source paper, which can cause portions of the board to shrink after the adhesive has set, is the principle cause of warping and the resulting waste encountered in manufacturing corrugated board. Accordingly, it is important to dry the source paper evenly before the medians and liners are brought together to form the board. To prevent warping, the source paper is passed through a preheater assembly that dries the source paper before it is processed by a machine for manufacturing corrugated board.

The preheater assembly typically includes a continuous web feeder, such as an unroller for feeding a continuous web of paper from a long sheet of paper wound around a core, a dryer, and a tension roller located between the feeder and the dryer for taking any slack out of the paper web. The dryer typically includes a large heated drum and two smaller idler rollers that keep the paper web in contact with the heated drum over a substantial portion of the circumference of the heated drum. From the dryer, the paper web travels to the machine for manufacturing corrugated board. Typically, the next stage in the assembly line is either a corrugator section, which flutes a paper web to create a median, or a single-facer section, which places a layer of adhesive between a median and a liner.

In order for the preheater to dry the paper properly, the paper web must be held tightly against the heated drum. If slack develops in the paper web, bubbles can form between the paper and the heated drum resulting in uneven moisture content in the paper exiting the dryer. Preventing slack from developing in the paper can be difficult, however, because the paper may have been rolled onto the core with uneven tension across the length of the paper roll. Typically, this causes one edge of the paper web to be taught while the other edge develops slack. This slack can remain in the web after it travels over the tension roller, over the first idler roller, and onto the heated drum, causing bubbles or loose edges to develop between the web and the drum.

In one conventional moving-web slack-reducing system designed to overcome this problem, the paper web is fed over a vertically-actuated tension roller. The vertical actuators, one typically placed at each end of the tension roller, allow each end of the tension roller to be lifted and lowered a small amount in an attempt to take any slack out of the paper web. But this solution is somewhat wanting in performance because removing the slack from the web requires precise positioning of the actuators. In addition, the tension tends to vary quickly across the paper web as the paper is unrolled. Removing the slack from the web under these conditions therefore requires fairly rapid and precise adjustments of the actuators, which are difficult to achieve at a reasonable level of investment.

Therefore, there is a need for a preheater assembly for a machine for manufacturing corrugated board that results in a paper web leaving the preheater assembly with a relatively even moisture content. There is a further need for a preheater assembly that removes the slack from a paper web without having to rely on fairly rapid and precise adjustments of a vertically-actuated tension roller.

SUMMARY OF THE INVENTION

The present invention satisfies the needs described above by providing a moving-web slack reducing system including a deformable tension roller, such as a brush-type tension roller having an outer surface defined by the ends of a plurality of bristles. The slack reducing system may be deployed in a preheater assembly for a machine for manufacturing corrugated board. The bristles of the deformable tension roller allow the outer surface of the tension roller to deflect both radially and in the cross-machine direction without binding to the paper web. The bristles may also deflect variably across the tension roller in the cross-machine direction. Thus, the deflection of the bristles adjusts automatically and virtually instantaneously to changes in the tension of the paper web to compensate for variations in tension across the web in the cross-machine direction. This allows the brush-type tension roller to take the slack out of the paper web without having to rapidly and precisely adjust any actuators.

Generally described, the invention is a slack reducing system for an assembly line that includes a continuous web feeder. An intermediate roller receives the web from the feeder and feeds the web further down the assembly line. A brush-type tension roller is positioned between the feeder and the intermediate roller so that the web contacts a portion of the outer surface of the tension roller as the web travels from the feeder to the intermediate roller. The brush-type tension roller includes an outer surface defined by the ends of a plurality of bristles, each of which may be crimped to form peaks and valleys.

According to another aspect of the invention, a preheater assembly for a machine for manufacturing corrugated board includes a continuous web feeder. A dryer receives the web from the feeder and feeds the web to a machine for manufacturing corrugated board. A tension roller including a deformable outer surface is positioned between the feeder and the dryer so that the web contacts a portion of the outer surface of the tension roller as the web travels from the feeder to the dryer. The dryer may include a heated drum and an idler roller that is positioned relative to the heated drum so that the web contacts a portion of the outer surface of the heated drum as the web travels from the feeder to the machine for manufacturing corrugated board.

Although the deformable tension roller may be deployed without vertical actuators, the tension roller may also be deployed with vertical actuators if additional control is desired. In this case, the tension roller includes a first vertical actuator for raising and lowering the first end of the tension roller with respect to a support structure, and a second vertical actuator for raising and lowering the second end of the tension roller with respect to the support structure. A controller, which is functionally connected to the first and second vertical actuators, is operative for varying the height of the first and second ends of the tension roller with respect to the support structure.

Accordingly, it is an object of the invention to provide a preheater assembly for a machine for manufacturing corrugated board that results in a paper web leaving the preheater assembly with a relatively even moisture content. It is a further object of the invention to provide a preheater assembly that removes the slack from a paper web without having to rely on fairly rapid and precise adjustments of a vertically-actuated tension roller.

DETAILED DESCRIPTION

Figure 1:
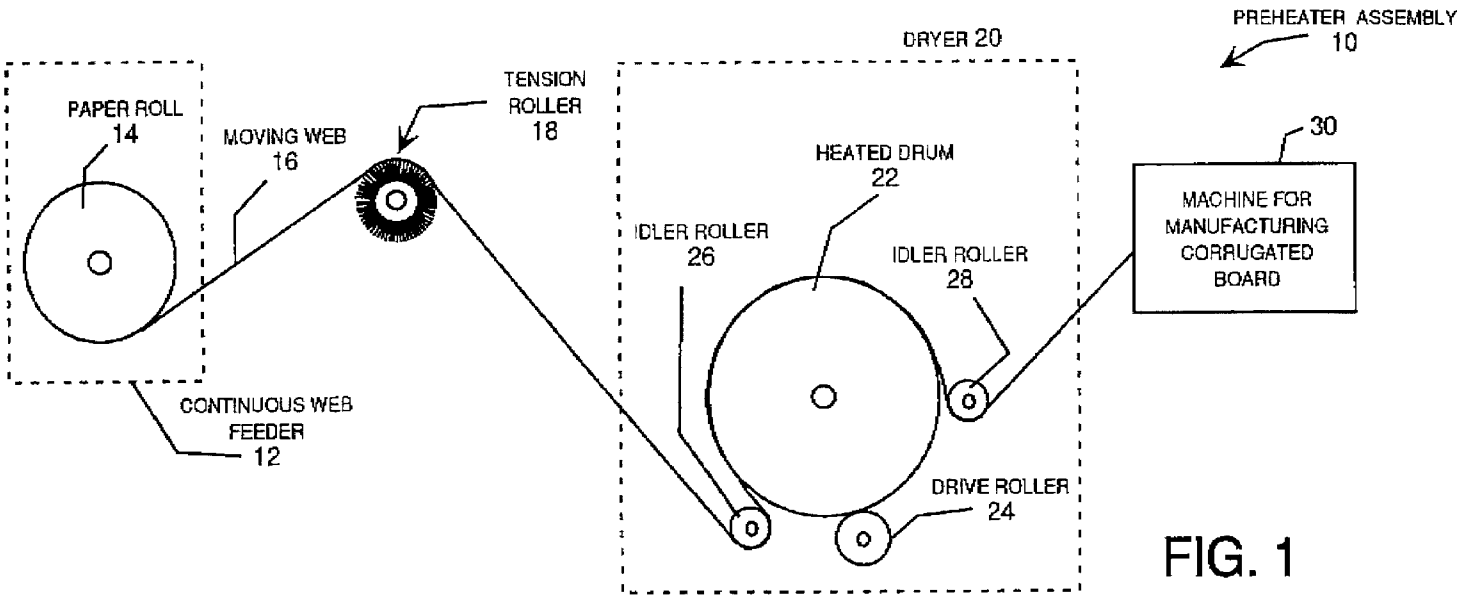
FIG. 1 is a diagram of a preheater assembly including a deformable tension roller assembly.

Turning now to the drawings, in which like numerals indicate like elements throughout the several figures, FIG. 1 is a diagram of a preheater assembly 10 including a deformable tension roller assembly. The preheater assembly 10 is an assembly line for processing a moving web of material in which the direction of machine flow is from left to right as shown in FIG. 1. The preheater assembly 10 begins with a feeder 12 for feeding a continuous web of material, such as an unroller for a roll of paper 14 that produces a moving web of paper 16.

This moving web 16 is of considerable width, such as 30 to 90 inches or more in the cross-machine direction, so that the moving web 16 tends to develop slack in the cross-machine direction as the web 16 leaves the feeder 12. Furthermore, the paper of the roll 14 may have been wound onto the core of the roll with uneven tension across the roll. This typically causes the moving web 16 to develop slack in the cross-machine direction as the web 16 is unrolled from roll of paper 14. It should be understood that the unroller for the roll of paper 14 may be replaced by other types of continuous web feeders 12, such as the output end of an assembly line for manufacturing the continuous web of material 16. It should also be understood that many materials other than paper could form the moving web 16, such as fiberglass, cloth, plastic, nylon, canvas, a woven web, a non-woven web, etc.

In the preferred embodiment, which is a preheater assembly 10 for a machine for manufacturing corrugated board, the moving web of paper 16 passes from the feeder 12 over a tension roller 18 and then through a dryer 20. Although many types of dryers may be employed, the preferred dryer 20 includes a heated drum 22 that is driven by a drive roller 24. The moving web 16 passes over a first idler roller 26, over the heated drum 22, and then over a second idler roller 28. As shown in FIG. 1, the idler rollers 26 and 28 are positioned relative to the heated drum 22 so that the moving web 16 contacts with the heated drum 22 over a significant portion of the outer surface of the heated drum 22. This contact between the moving web 16 and the heated drum 22 preferably dries the web so that it has an even moisture content as it exits the dryer 20. The positions of the idler rollers 26 and 28 may typically be varied to change the amount of the outer surface of the heated drum 22 contacted by the moving web 16 to adjust for the weight of the source material, the speed of the web, and the moisture content of the source material.

In an application for manufacturing corrugated paper board as shown in FIG. 1, the paper web 16 travels from the dryer 20 to a machine for manufacturing corrugated board 30. For example, a typical machine 30 is described in Lauderbaugh, U.S. patent application Ser. No. 08/7881,923 entitled "Machine for Manufacturing Corrugated Board" filed on Mar. 20, 1997, which is owned by a common assignee and incorporated by reference. It should be understood, however, that the slack reducing system provided by the deformable tension roller 18 may be deployed in other types of moving-web assembly lines.

In a typical preheater assembly 10, the paper web 16 may range in weight from about 17 lb. per 100 square feet to about 90 lb. per 100 square feet and travel at linear speeds from 50 to 500 feet per minute or more. The web 16 typically ranges from 30 to 90 inches or more in the cross machine direction and two or more separate webs may run through the preheater assembly 10 simultaneously. With respect to the dryer 20, a typical idler roller 26, 28 may be about 5⁹⁄₁₆ inches in diameter and the heated drum 22 typically ranges from about 36 to about 44 inches in diameter.

The gap between an idler roller 26, 28 and the heated drum 22 is typically about one inch and the temperature of the outer surface of the heated drum 22 typically ranges from about 325° F. to about 350° F. The distance between the tension roller 18 and the heated drum 22 may vary considerably. For example, a typical preheater assembly may have ten feet of the web 16 between the center of the tension roller 18 and the center of the heated drum 22. To save floor space, the tension roller 18 may be elevated with respect to the heated drum 22 so that the distance along the floor between the center of the tension roller 18 and the center of the heated drum 22 may be only about three feet.

As noted previously, uneven moisture content in the paper web 16 is the principle cause of warping and the resulting waste encountered in manufacturing corrugated board. To avoid this type of warping, the paper web 16 is passed through the dryer 20 to dry the web evenly before the medians and liners are brought together to form the board. In order for the dryer 20 to dry the paper web 16 evenly in the cross-machine direction, the web must be held tightly against the heated drum 22. If slack develops in the paper web 16, bubbles or loose edges can form between the web and the heated drum 22, resulting in uneven moisture content in the paper web 16 exiting the dryer 20.

Passing the paper web 16 over the tension roller 18 having a deformable outer surface takes any slack out of the paper web 16. For example, the bristles of a brush-type tension roller 18 may deflect both radially and in the cross-machine direction without binding to the paper web 16. In addition, the bristles may deflect variably across the tension roller 18 in the cross-machine direction. Moreover, when the material, size, shape, and density of the bristles are selected properly, as described below, the deflection of the bristles adjusts automatically and virtually instantaneously to changes in the tension of the paper web 16 to compensate for variations in tension across the web in the cross-machine direction.

Advantageously, the deflection of the bristles allows the brush-type tension roller 18 to take the slack out of the paper web 16 without having to rapidly and precisely adjust any actuators. Thus, in one embodiment of the invention, the brush-type tension roller 18 may be supported by a rigid support structure without the need for vertical actuators that are operative for adjusting the height of the ends of the tension roller 18, as found in conventional moving-web slack reducing systems. Thus, the brush-type tension roller 18 provides a significantly less expensive, as well as more effective, moving-web slack reducing system.

Figure 2:
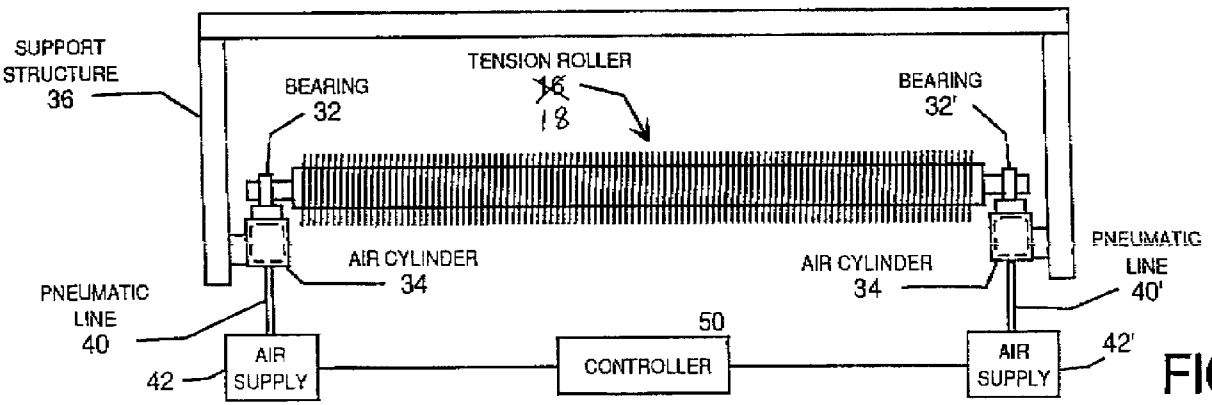
FIG. 2 is a diagram showing a cross-machine view of a vertically-actuated deformable tension roller assembly.

Nevertheless, it may be desirable to provide additional slack reducing capability by deploying the deformable tension roller 18 in conjunction with a vertical actuator system. FIG. 2 is a diagram showing a cross-machine view of a vertical actuator system for a deformable tension roller assembly. The brush-type tension roller 18 includes journals on either end that are rotatably supported by bearings 32 and 32'. These bearings, in turn, are supported by vertical actuators, such as the movable pistons of air cylinders 34 and 34'. The frames of these air cylinders are affixed to a rigid support structure 36. Pneumatic lines 40 and 40' connect the air cylinders 34 and 34' to air supplies 42 and 42', respectively.

A controller 50 is operable for varying the air pressure supplied to the air cylinders 34 and 34' so as to vary the height of either end of the tension roller 18. The controller 50 may be adjusted manually or configured to automatically adjust the height of either end of the tension roller 18 in response to sensors, such as hinge- or plunger-type limit sensors, that measure the tension at the edges of the web 16. Air cylinders 34 and 34' capable of producing approximately one inch of vertical travel provide an adequate amount of slack reducing capability for a typical preheater assembly 10. For example, air cylinders having a one inch vertical stroke and 182 lb. of vertical pressure at 62 psi line pressure have been found to operate acceptably in association with the preheater assembly 10 described above, in both the vertically-fixed and the vertically-actuated tension roller configurations.

Figure 3:
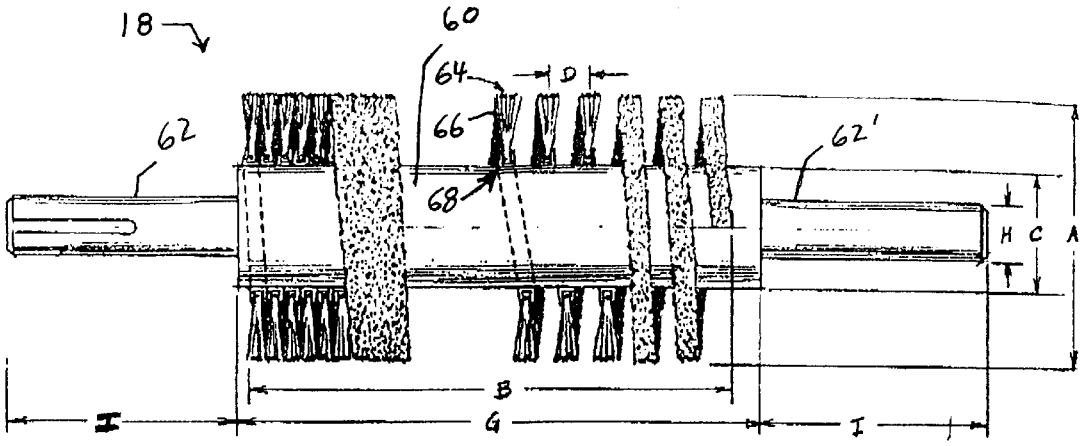
FIG. 3 is a diagram showing the construction of a brush-type deformable tension roller.

FIG. 3 is a diagram showing the construction of a brush-type deformable tension roller 18 that has been found to operate effectively in a slack-reducing system for the preheater assembly 10 described above. The tension roller 18 is constructed from a hollow cylindrical core 60 with base-mounted journals 62 and 62' press-fitted into either end. A linear bristle assembly 64, which is constructed from a plurality of bristles 66 supported by a "U" shaped backing 68, is wrapped around the cylindrical core 60.

Typical dimensions associated with the brush-type tension roller 18 are as follows: The outer diameter "A" of the tension roller 18 is 8 1/16 inches; the length "B" of the bristled portion of the tension roller 18 is 88 inches; the outer diameter "C" of the cylindrical core 60 is 5 9/16 inches; the wall thickness of the cylindrical core 60 is ¼ inch; the distance "D" between turns of the linear bristle assembly 64 is zero (i.e., the turns of the bristle assembly are "close packed" so that backings of successive turns are immediately adjacent to each other); the length "G" of the cylindrical core 60 is 89 inches; the diameter "H" of each journal 62, 62' is 1½ inches; and the length "I" of each journal 62, 62' is three inches.

Figure 4:
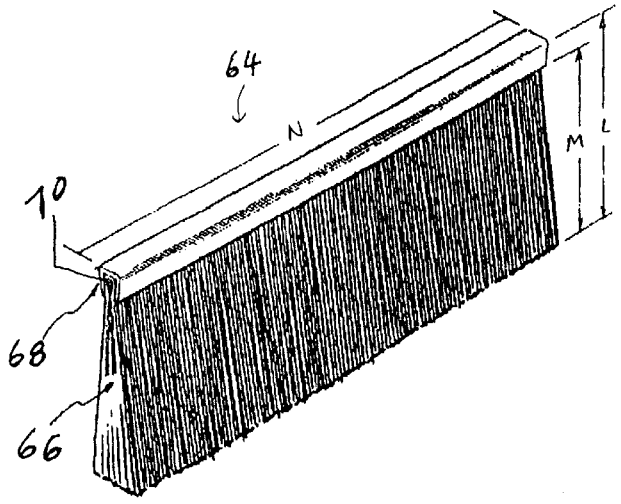
FIG. 4 is a diagram showing the construction of the bristle assembly of the brush-type deformable tension roller of FIG. 3.

FIG. 4 is a diagram showing the construction of the bristle assembly 64 of the brush-type deformable tension roller 18 of FIG. 3. The bristles 66 are formed in pairs, each pair being formed from the ends of a single strand that is looped around a center filament 70. Each strand is 2⅝ inches long so that when doubled over it forms two bristles, each having a length "L" of 1 5/16 inches. The backing 68 is 5/16 inch in height so that the unrestrained length "M" of the bristles is about one inch. Each bristle 66 is preferably a 0.012 inch in diameter (i.e., 0.012 gauge) extruded type 6.6 nylon monofilament. The bristles 66 are packed to have about 800 bristles (i.e., 400 strands) per linear inch of the backing 68. When closely wrapped around the core 60, this produces about 2,500 bristles per square inch. The tension roller 18 preferably includes about 88 turns of the bristle assembly 64. Thus, the total length "N" of the bristle assembly 64 is about 42¾ yards.

Figure 5:
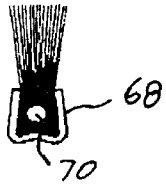
FIG. 5 is an end view of the bristle assembly of FIG. 4.

FIG. 5 is an end view of the bristle assembly 64. The backing 68 is constructed from a strip of electro-galvanized steel or stainless steel about ⅞ inch wide by about 0.035 inch thick. After forming, the backing 68 about 5/16 inch wide and about 5/16 inch high. The center filament 70 is about 1/10 inch in diameter (i.e., 0.100 gauge) extruded steel monofilament cable.

Figure 6:
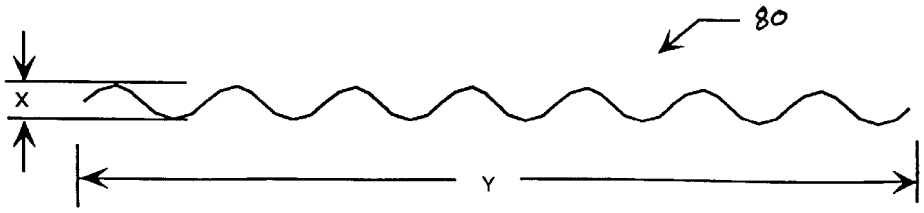
FIG. 6 is a diagram of one strand of the bristle assembly of FIG. 4.

FIG. 6 is diagram of one strand 80 of the bristle assembly 64. The strand 80 is preferably crimped into a zig-zag or sinusoidal-type shape forming peaks and valleys. Specifically, the peak-to-valley amplitude "X" is about 0.022 inch and the length "Y" of the crimped strand is 2⅝ inches.

The invention thus provides a preheater assembly for a machine for manufacturing corrugated board that results in a paper web leaving the preheater assembly with a relatively even moisture content. The invention also provides a preheater assembly that removes the slack from a paper web without having to rely on fairly rapid and precise adjustments of a vertically-actuated tension roller. It should be understood that the foregoing relates only to specific embodiments of the invention, and that numerous changes may be made therein without departing from the invention as defined by the following claims. In particular, it should be appreciated that all of the dimensions set forth above may be varied somewhat without adversely affecting to performance of the moving-web slack reducing system.

What is claimed is:

1. A preheater assembly in combination with a machine for manufacturing corrugated board comprising:

a continuous web feeder for feeding a continuous web of material;

a dryer operable for receiving the web from the feeder and operable for feeding the web to the machine for manufacturing corrugated board; and a tension roller comprising a deformable outer surface positioned between the feeder and the dryer so that the web contacts a portion of the outer surface of the tension roller and causes the outer surface of the tension roller to resiliently deform in response to tension in the web as the web travels from the feeder to the dryer across the tension roller, said resilient deformation removing slack from the web and thereby evening a drying action applied to the web as the web travels over the dryer, wherein the outer surface of the tension roller comprises the ends of a plurality of bristles.

2. The preheater assembly in combination with a machine for manufacturing corrugated board of claim 1, wherein the dryer includes a heated drum and an idler roller, the idler roller positioned relative to the heated drum so that the web contacts a portion of the outer surface of the heated drum as the web travels from the feeder to the machine for manufacturing corrugated board.

3. The preheater assembly in combination with a machine for manufacturing corrugated board of claim 2, wherein the tension roller comprises first and second ends supported by a support structure, further comprising:

a first vertical actuator for raising and lowering the first end of the tension roller with respect to the support structure;

a second vertical actuator for raising and lowering the second end of the tension roller with respect to the support structure; and a controller functionally connected to the first and second vertical actuators for varying height of the first and second ends of the tension roller with respect to the support structure.

4. The preheater assembly in combination with a machine for manufacturing corrugated board of claim 3, wherein the feeder comprises an unroller for unrolling a roll of the material.

5. The preheater assembly in combination with a machine for manufacturing corrugated board of claim 1, wherein each bristle is crimped to define peaks and valleys.

6. A method for removing moisture from a material to be corrugated into board comprising the steps of:

feeding a continuous web of the material across a tension roller comprising a deformable outer surface so that the web contacts a portion of the outer surface of the tension roller and causes the outer surface of the tension roller to resiliently deform in response to tension in the web and wherein the outer surface of the tension roller comprises the ends of a plurality of bristles;

feeding the web from the tension roller over a dryer, said resilient deformation removing slack from the web and thereby evening a drying action applied to the web as the web travels over the dryer; and feeding the web from the dryer to a machine for manufacturing corrugated board.

7. The method of claim 6, wherein the step of feeding the continuous web of the material through the dryer comprises the steps of:

feeding the web from the tension roller over an idler roller;

feeding the web from the idler roller over a heated drum; and positioning the idler roller relative to the heated drum so that the web contacts a portion of the outer surface of the heated drum.

8. The method of claim 7, wherein the step of feeding the continuous web of the material over the tension roller comprises the steps of:

positioning a first vertical actuator between a first end of the tension roller and a support structure;

positioning a second vertical actuator between a second end of the tension roller and the support structure; and varying height of the first and second ends of the tension roller with respect to the support structure.

9. The method of claim 8, further comprising the step of unrolling a roll of the material prior to the step of feeding the continuous web of the material over the tension roller.

10. The method of claim 6, wherein each bristle is crimped to define peaks and valleys.

11. The preheater assembly of claim 1, wherein the tension roller is not rotationally driven.

12. The method of claim 6, wherein the tension roller is not rotationally driven.

13. The method of claim 6 wherein the material is paper.

* * * * *